US009642762B2

(12) United States Patent
Frueh et al.

(10) Patent No.: US 9,642,762 B2
(45) Date of Patent: May 9, 2017

(54) METHOD AND DEVICE FOR OPERATING A MOBILE OPERATING TABLE

(71) Applicant: MAQUET GMBH, Rastatt (DE)

(72) Inventors: Michael Frueh, Achern (DE); Matthias Joerger, Kleinfeld (DE); Timo Pfirrmann, Steinmauern (DE)

(73) Assignee: MAQUET GMBH, Rastatt (DE)

( * ) Notice: Subject to any disclaimer, the term of this patent is extended or adjusted under 35 U.S.C. 154(b) by 89 days.

(21) Appl. No.: 14/783,803

(22) PCT Filed: Apr. 15, 2014

(86) PCT No.: PCT/EP2014/057614

§ 371 (c)(1),
(2) Date: Oct. 9, 2015

(87) PCT Pub. No.: WO2014/170322

PCT Pub. Date: Oct. 23, 2014

(65) Prior Publication Data

US 2016/0030265 A1 Feb. 4, 2016

(30) Foreign Application Priority Data

Apr. 15, 2013 (DE) ..... 10 2013 103 757

(51) Int. Cl.

| | |
|---|---|
| ***A61G 13/10*** | (2006.01) |
| ***A61G 7/08*** | (2006.01) |
| ***A61G 13/00*** | (2006.01) |

(52) U.S. Cl.

CPC ..... *A61G 13/104* (2013.01); *A61G 7/08* (2013.01); *A61G 13/00* (2013.01); *A61G 2203/12* (2013.01); *A61G 2203/80* (2013.01)

(58) Field of Classification Search

CPC ..... A61G 13/104; A61G 7/08; A61G 13/00; A61G 2203/80; A61G 2203/12

See application file for complete search history.

(56) References Cited

U.S. PATENT DOCUMENTS 6,101,647 A * 8/2000 Stroud ..... A47C 20/041 5/613
6,851,144 B2 * 2/2005 Wang ..... A61G 7/015 5/109

(Continued)

FOREIGN PATENT DOCUMENTS

DE 43 19 525 A1 12/1994
DE 69425045 T2 3/2001

(Continued)

OTHER PUBLICATIONS

International Search Report dated Aug. 4, 2014, issued in PCT/EP2014/057614 (with English translation).

*Primary Examiner* — Frederick Brushaber

(57) ABSTRACT

A device for controlling an operating table is disclosed. The device has a controller that controls a traction drive device that moves the operating table. The device also has at least one control element disposed on the controller. The traction drive device moves the operating table from a stopped state to a first speed based on a first actuation of the at least one control element. The traction drive device increases the operating table speed from the first speed to a second speed based on the first actuation of the at least one control element being interrupted for a first time period that is shorter than a first interruption time period and based on a double actuation of the at least one control element.

20 Claims, 3 Drawing Sheets

(56) References Cited

U.S. PATENT DOCUMENTS

| | | | | |
|---|---|---|---|---|
| 7,150,056 | B2 * | 12/2006 | Lemire | A61G 7/012 5/11 |
| 7,398,571 | B2 * | 7/2008 | Souke | A61G 1/0212 296/20 |
| 7,690,059 | B2 * | 4/2010 | Lemire | A61G 7/005 5/600 |
| 7,805,784 | B2 * | 10/2010 | Lemire | A61G 7/005 108/145 |
| 7,827,634 | B2 * | 11/2010 | Stroth | A61G 7/08 180/19.1 |
| 8,006,332 | B2 * | 8/2011 | Lemire | A61G 7/005 5/600 |
| 8,312,578 | B2 | 11/2012 | L'Hegarat | |
| 9,517,172 | B2 * | 12/2016 | Kume | A47C 20/08 |
| 2003/0195644 | A1 * | 10/2003 | Borders | A47C 31/008 700/90 |
| 2006/0174405 | A1 * | 8/2006 | Johnson | A61G 7/1019 5/81.1 R |
| 2008/0249437 | A1 * | 10/2008 | Phillips | A61H 1/003 601/26 |

FOREIGN PATENT DOCUMENTS

| | | | |
|---|---|---|---|
| DE | 19955116 | A1 | 5/2001 |
| DE | 10336303 | A1 | 3/2005 |
| EP | 2085062 | A2 | 8/2009 |
| WO | WO 02/074216 | A2 | 9/2002 |
| WO | WO 2010/030788 | A2 | 3/2010 |

* cited by examiner

METHOD AND DEVICE FOR OPERATING A MOBILE OPERATING TABLE

CROSS REFERENCE TO RELATED APPLICATIONS

This application is a national stage filing pursuant to 35 U.S.C. §371 of PCT/EP2014/057614, filed on Apr. 15, 2014, and claiming benefit of priority to German Patent Application No. 10 2013 103757.7 filed on Apr. 15, 2013, all the contents of which are incorporated by reference herein.

TECHNICAL FIELD

The invention relates to a method and a device for operating a mobile operating table having a patient support surface, an operating table column and an operating table column base. The operating table further has rollers and a traction drive unit for moving the operating table. The traction drive unit is activated by the actuation of a control element assigned to the traction drive unit.

BACKGROUND

Three different types of operating tables are typically used in hospitals, namely stationary operating tables, movable operating tables and mobile operating tables. Stationary operating tables have an operating table column permanently fixed to the floor of the operating room. Normally, stationary operating tables do not comprise an operating table column base. Movable operating tables have an operating table column base which is connected to the operating table column, has no rollers and no transport devices and stands on the floor of the operating room at least during a surgical operation. The movable operating tables are liftable and movable by means of transport carriages. Such a system which comprises a movable operating table and a transport carriage is also referred to as a mobile operating table system.

The operating table column bases of mobile operating tables have rollers for moving the operating table, Mobile operating tables are thus movable without further auxiliary means. In the case of mobile operating tables, the rollers are lockable so that the operating table is not movable during a surgical operation, and/or the column base can be lowered with respect to the rollers so that the operating table stands safely on the floor during a surgical operation.

Further, in the case of mobile operating tables, electric traction drives including soft start and safety brake function are known in order to move the mobile operating table by the electric traction drive. This traction drive unit is actuated via at least one control element, in particular via a non-wireless or a wireless remote control. In the case of traction drive units with at least two speed levels, a changing of the speed level is then possible. This is particularly useful when a mobile operating table has been moved out of the operating room and shall be moved further, for example, along a corridor of an operating wing over a longer distance. In the operating room itself, the maneuvering is problematic because of the usually quite narrow space and a significant number of obstacles so that a low drive speed of the traction drive is appropriate. However along long corridors, as are common in the operating wing of hospitals, a higher speed is desirable to facilitate a fast work flow. In known switching operations, the movement or the operating table is stopped for a short period of time to allow for changing the speed level and a complex setting of the desired higher speed level via a menu of the control device or the remote control is carried out. To reset the lower speed level afterwards, the procedure for setting the speed level is performed repeatedly in the menu of the control device. As a result, a changing of the speed is relatively complex in known mobile operating tables. An alternative possibility for changing the speed could be that one separate control element is provided for each speed level on the control device, in particular a remote control. However, this makes use of the control device undesirable. In particular, when the control device also serves to operate adjustable components of an operating table during a surgical operation, it is not useful (e.g., for reasons of clarity) to provide a plurality of control elements for functions that are not required during the surgical operation itself.

From document DE 19955116 A1, a control unit for controlling the drives of an operating table support surface is known, the support surface being removable from an operating table column and comprising components adjustable by an electric motor, the control unit comprising an energy supply, a control and a control device. The control device is integrated in a transport carriage for the transport of the operating table support surface.

SUMMARY OF THE DISCLOSURE

Based on shortcomings in the prior art, a method and a device for operating a mobile operating table is provided, by which a simplified activation of a traction drive unit for moving the operating table at different drive speeds is possible.

By a method for operating a mobile operating table, a first drive speed is activated by a single actuation of the control element and a second drive speed is activated by a double actuation of the control element.

A double actuation may be a double click. A double click may be a double activation of the actuating element within a preset period of time between a first actuation of the control element and a second actuation of the control element, or an inverse double click, (for example, the single deactivation of the control element for a maximum preset interruption time and/or the double deactivation of the control element for a respective maximum preset interruption time within a preset period of time between the first deactivation of the control element and the second deactivation of the control element).

By a double actuation of the control element, an easy change of the drive speed from the first drive speed to the second drive speed of the traction drive unit that is activated with the first drive speed is possible without the traction drive unit having to be deactivated in the meantime.

Further, the change of the drive speed is possible with only one control element. As a result, the present method and apparatus may allow a suitable intuitive actuation of the control element for activating the first drive speed and for activating the second drive speed of the traction drive unit. The first drive speed is preferably slower than the second drive speed. As a result, the first drive speed can be used for moving the operating table slowly (e.g., for the exact positioning and/or for maneuvering the operating table), and the second drive speed can be used for moving longer distances at higher speed.

The drive speed of the traction drive unit may be changed from the first drive speed to the second drive speed by a double actuation. As a result, a suitable change of the drive speed is possible that minimally affects the work flow in the operating room and in the operating wing of a hospital.

In the case in which a double actuation is accomplished by an interruption of the actuation of the first control element, for double actuation the interruption may be shorter than a preset Interruption Period. The Interruption Period may be preset to a value in a range between 100 ms (milliseconds) and 800 ms, for example to a value in a range between 200 ms and 500 ms. Also for example, an Interruption Period can be preset to a value of 300 ms. As a result, an easy and convenient actuation of the control element for activating the second drive speed is possible.

A double actuation may be accepted when the interruption is longer than 30% of the preset Interruption Period or the interruptions are each longer than 30% of the preset Interruption Period. In the case of a preset Interruption Period (for example, of about 300 ms), the minimum Interruption Period for the double actuation may be 90 ms. As a result, operating errors, in particular from bouncing a switching element of the actuation element, are effectively prevented.

Further, the traction drive unit may be deactivated when the first control element has not been actuated for a preset Interruption Period. As a result, the traction drive unit may not remain activated when the actuation element is no longer actuated, so that an undesirable operation does not occur.

Further, the first drive speed of the traction drive unit may be again activated by a double actuation of the first control element in case the second drive speed of the traction drive unit is activated. In this way, a simplified change from the second drive speed to the first drive speed is possible without the traction drive unit having to be stopped.

Alternatively thereto, a third drive speed can be activated by a double actuation of the first control element in case the second drive speed is activated. The third drive speed may be faster than the second drive speed so that a faster drive speed can be selected.

A second control element may be provided, which, when actuated, releases the traction drive unit for driving the operating table. In the case of a single actuation of the first control element, the traction drive unit may be activated with the first drive speed. In the case of a double actuation of the first control element, the traction drive unit may be activated with the second drive speed. For example, the traction drive unit can only be activated when the second control element is actuated, with the traction drive unit being deactivated when the second control element is not actuated. As a result, the first control element may only be actuated by a single actuation for activating the first drive speed and by a double click for activating the second drive speed (e.g., a non-inverse double click or a "normal" double click can be used for actuation), which may make a relatively more intuitive operation possible, as compared to the case of an inverse double click.

Further, in the case of further double actuations of the first control element, the traction drive unit may be activated with a respective higher drive speed until the maximum drive speed of the traction drive unit is reached. Alternatively, in the case of a repeated double actuation of the first control element, the traction drive unit (e.g., in case the second drive speed is activated) can again be activated at the first drive speed.

As a result, an easy change and selection of different speed levels is easily possible.

A braking unit may be additionally activated upon, or after, deactivation of the traction drive unit. In this way, the movement of the operating table can be stopped to avoid unsuitable operation. In the case of a non-activated traction drive unit, a movement of the mobile operating table can effectively be stopped in a simplified manner using the braking unit.

A second aspect of the present concept relates to a device for operating a mobile operating table having a patient support surface, an operating table column and an operating table column base, wherein the operating table column base has rollers and a traction drive unit for moving the operating table. Further, the device may have a first control element, by the actuation of which a control unit of the device activates the traction drive unit. The control unit may activate the traction drive unit with a first drive speed by a single actuation of the control element. Further, the control unit may activate the traction drive unit with a second drive speed by a double actuation of the control element. In this way, an easy activation and/or change of the drive speed of the traction drive unit of the operating table is possible.

The disclosed method may be executed by the control unit controlling the control elements and the traction drive unit.

The first and/or second control element can be provided by a remote control (e.g., a non-wireless or a wireless remote control of the operating table) or by control elements directly arranged on the operating table.

The speed may change from a standstill to the first drive speed, from the first drive speed to the second drive speed, from the second drive speed to a higher third drive speed, from the third drive speed to the second drive speed, from the second drive speed to the first drive speed, and/or from the first drive speed to a standstill (which may, for example, take place via acceleration ramps, e.g., with a uniform positive or negative acceleration). As a result, jerky accelerations may be avoided and a "soft start" can be accomplished.

Further features and advantages of the present apparatus and method may result from the following description, which explains the present apparatus and method in more detail on the basis of embodiments in connection with the enclosed Figures.

DETAILED DESCRIPTION

Figure 1:
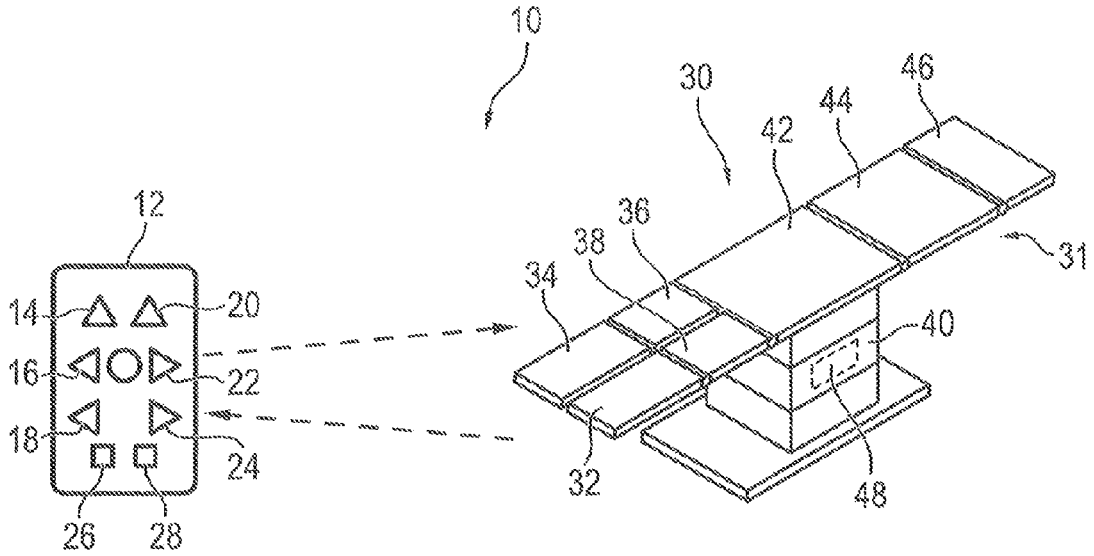
FIG. 1 shows a mobile operating table with several components which may be adjustable by an electric motor with the aid of a wireless remote control as well as a traction drive unit for moving the operating table which can be activated via the wireless remote control with two speed levels, the operating table being illustrated in a first lowered position.

FIG. 1 shows a system 10 that may include a remote control 12 having several control elements 14 to 28 (e.g., 14, 16, 18, 20, 22, 24, 26, and 28), through which adjustable components 32 to 46 (e.g., 32, 34, 36, 38, 40, 42, 44, and 46) of a mobile operating table 30 can be adjusted (e.g., can be changed in position and/or with respect to other components 32 to 46). The individual components 32 to 46 or groups of these components 32 to 46 may be assigned to the control elements 14 to 24 of the remote control 12 so that when a control element 14 to 24 is actuated a corresponding adjusting action of the component 32 to 46 or a component group assigned to this control element 14 to 24 is performed. The mobile operating table 30 may have an operating table column base, a patient support surface 31 which may comprise the components 32 to 36 and 42 to 46, and an operating table column 40 arranged between the operating table column base and the patient support surface 31. Inside the operating table column 40, a traction drive unit 48 may be arranged which comprises a control unit for controlling the traction drive of the mobile operating table 30, an electric motor for the traction drive of the mobile operating table 30, and an accumulator for the energy supply of the control unit and of the electric motor. In the lowered state of the mobile operating table 30, as illustrated in FIG. 1, the rollers 50 to 56 (e.g., 50, 52, 54, and 56) provided for moving the operating table 30 are arranged inside the operating table base and do not project downwardly beyond support elements on which the operating table column base is supported on a floor in the lowered state.

Figure 2:
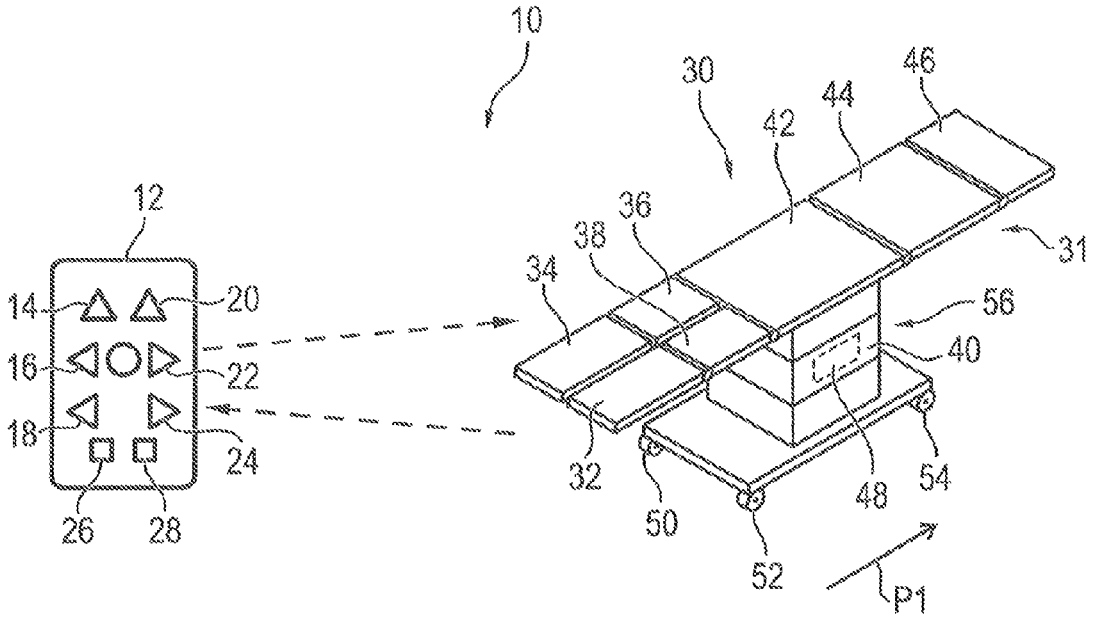
FIG. 2 shows the operating table according to FIG. 1 in a second lifted position for moving the operating table.

In FIG. 2, the system 10 according to FIG. 1 is illustrated, wherein the rollers 50 to 56 of the mobile operating table 30 have been extracted downwardly so that the mobile operating table 30 can be moved with the aid of these rollers 50 to 56. The rollers 50 to 56 can be brought from their retracted position shown in FIG. 1 to their extracted position shown in FIG. 2 by an electric motor and/or an electrically driven or manually actuated hydraulic unit. For extracting the rollers 50 to 56, the control element 26 may be activated once. When the control element 26 is actuated again (e.g., once), the operating table 30 is again lowered from the lifted position shown in FIG. 2 into the lowered position shown in FIG. 1. When the control element 28 is activated once, the electric motor of the traction drive unit 48 is activated with a first drive speed so that the mobile operating table 30 is driven at this first drive speed in the direction of the arrow P1. The drive can take place via one or more rollers 50 to 56. It is also contemplated that a drive wheel or a drive drum may drive operating table 30.

The traction drive unit 48 or the electric motor remains activated with the first drive speed as long as the control element 28 is actuated. If the actuation of the control element 28 is interrupted for longer than a preset Interruption Period, then the traction drive unit 48 is deactivated (e.g., the drive of the operating table 30 is stopped by the electric motor and a brake being activated). If, on the other hand, the actuation of the actuating element 28 is interrupted for a time period shorter than the Interruption Period and subsequently once again interrupted for the time period shorter than the Interruption Period (e.g., when there is a double actuation of the control element 28), a second drive speed of the traction drive unit 48 may be activated. The electric motor may be driven such that it has a correspondingly higher output speed than in the case of the activation of the first drive speed.

INDUSTRIAL APPLICABILITY

Figure 3:
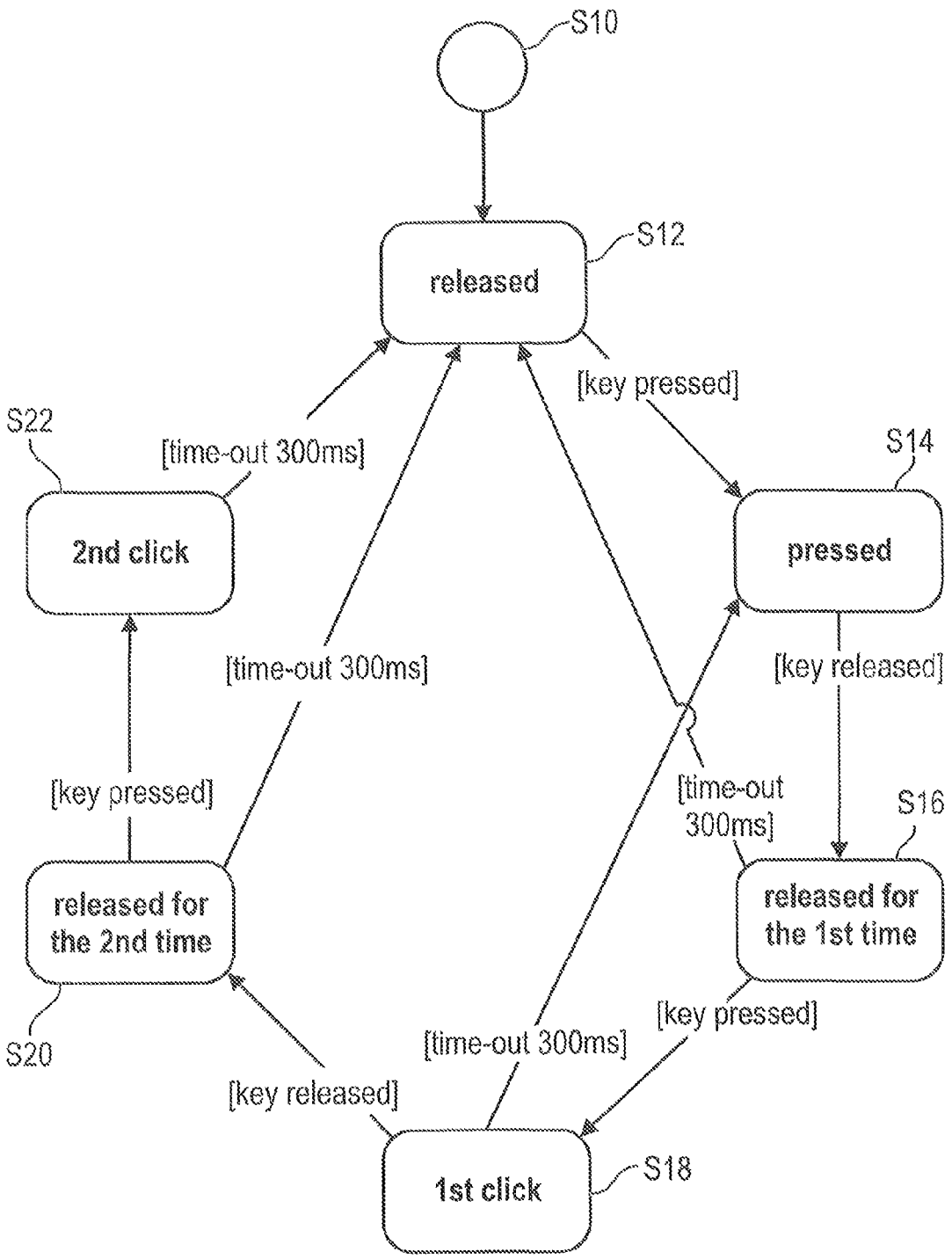
FIG. 3 shows a status diagram of a polling cycle of the actuating element for activating the traction drive unit of the operating table with the first drive speed, and for changing the speed level of the traction drive unit from the first drive speed to the second drive speed.

In FIG. 3, a state diagram showing states for activating and deactivating the control element 28 is illustrated. After the system has been initialized in step S10, the control element 28 is in the state S12 (e.g., "released") so that the traction drive unit is deactivated. If it is then detected that the control element 28 has been pressed, a change of state to the state S14 (e.g., "pressed") takes place, with a result of the traction drive unit 48 being activated at the first drive speed. If it is determined afterwards that the control element 28 is no longer activated (e.g., it has been released), a change of state from the state S14 to the state S16 (e.g., "released for the 1st time") takes place.

If it is determined that the control element 28 is released (deactivated or not actuated) for more than 300 ms, a change of state from the state S16 into the state S12 (e.g., "released") may take place, in which the traction drive unit 48 is deactivated.

If, however, the control element 28 is once again activated within these 300 ms, then a change of state from the state S16 to the state S18 (e.g., "1st click") takes place. If the control element 28 is not again released (deactivated or not actuated) within 300 ms, then after 300 ms a change of state from the state S18 to the state S14 (e.g., "pressed") takes place.

If however, within these 300 ms, a repeated release of the control element 28 takes place, then a change of state from the state S18 to the state S20 (e.g., "released for the 2nd time") takes place. If the control element 28 is not again activated within 300 ms, a change of state from the state S20 to the state S12 (e.g., "released") takes place, in which the traction drive unit 48 is deactivated. If, however, starting out from the state S20 another actuation of the control element 28 takes place within 300 ms, then a change of state from the state S20 to the state S22 (e.g., "2nd click") takes place, with the result of the second drive speed of the traction drive unit 48 being activated. If subsequently the control element 28 is not actuated, a change of state from the state S22 to the state S12 (e.g., "released") takes place so that the traction drive unit 48 is deactivated.

Figure 4:
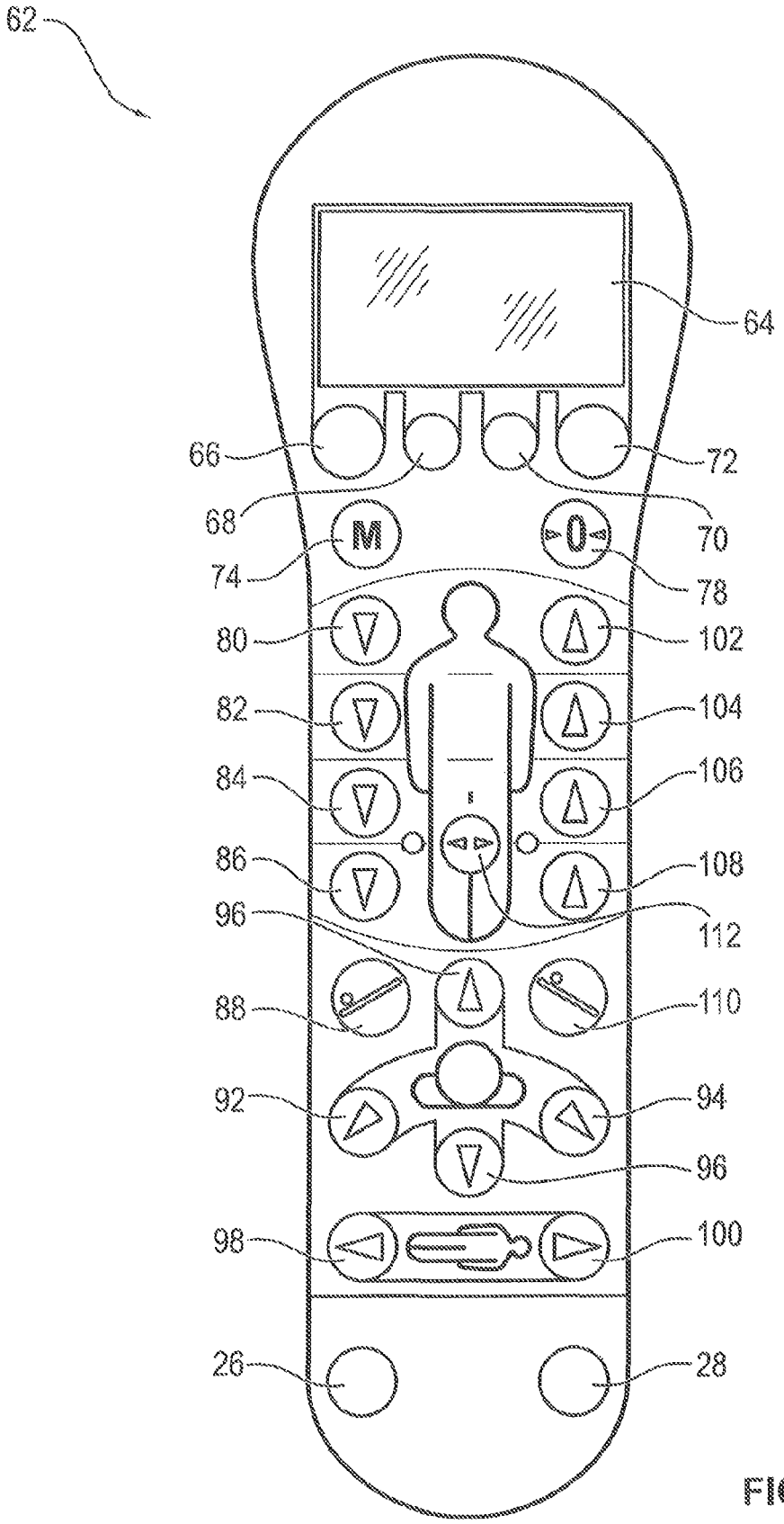
FIG. 4 shows an exemplary remote control for operating an operating table.

FIG. 4 illustrates another exemplary embodiment of a remote control. FIG. 4 illustrates a remote control 62, which can be used alternatively to the remote control 12. The remote control 62 may have a display 64 for the display of information. Further, the remote control 62 may have a plurality of control elements 66 to 112 (e.g., 66, 68, 70, 72, 74, 78, 80, 82, 84, 86, 88, 92, 94, 96, 98, 100, 102, 104, 106, 108, 110, and 112) via which different operating inputs for changing the position of the components 32 to 46 of the mobile operating table 30 can be input conveniently. In addition, the remote control 62 may have a control element 26 for extracting the transport rollers 50 to 56 as well as a control element 28 for activating the traction drive unit 48 with the first drive speed by a single actuation and with the second drive speed by a double actuation.

It will be apparent to those skilled in the art that various modifications and variations can be made to the disclosed method and apparatus. Other embodiments will be apparent to those skilled in the art from consideration of the specification and practice of the disclosed method and apparatus. It is intended that the specification and examples be considered as exemplary only, with a true scope being indicated by the following claims.

The invention claimed is:

1. A device for controlling an operating table, comprising:

a controller that controls a traction drive device that moves the operating table; and at least one control element disposed on the controller;

wherein the traction drive device moves the operating table from a stopped state to a first speed based on a first actuation of the at least one control element; and wherein the traction drive device increases the operating table speed from the first speed to a second speed based on the first actuation of the at least one control element being interrupted for a first time period that is shorter than a first interruption time period; and a double actuation of the at least one control element.

2. The device of claim 1, wherein the double actuation of the at least one control element includes a second actuation of the at least one control element following the first time period, the second actuation being within the first interruption time period.

3. The device of claim 2, wherein the traction drive device moves the operating table at the first speed as long as the second actuation is not interrupted.

4. The device of claim 2, wherein the double actuation of the at least one control element includes the second actuation of the at least one control element being interrupted for a second time period that is shorter than a second interruption time period.

5. The device of claim 4, wherein the traction drive device stops moving the operating table when the second actuation of the at least one control element is interrupted for a time period that is equal to or greater than the second interruption time period.

6. The device of claim 4, wherein the double actuation of the at least one control element includes a third actuation of the at least one control element following the second time period, the third actuation being within the second interruption time period.

7. The device of claim 6, wherein the traction drive device moves the operating table at the second speed as long as the third actuation is not interrupted.

8. The device of claim 1, wherein the traction drive device moves the operating table at the first speed as long as the first actuation is not interrupted.

9. The device of claim 1, wherein the first interruption time period is between about 100 ms and about 800 ms.

10. The device of claim 1, wherein the traction drive device is deactivated and stops moving the operating table when the first actuation of the at least one control element is interrupted for a time period that is equal to or greater than the first interruption time period.

11. The device according to claim 10, wherein an operating table brake operates to stop the operating table when the traction drive device is deactivated.

12. The device according to claim 1, wherein the first time period is greater than 30% of the first interruption time period.

13. A method, comprising:

providing an operating table;

providing a traction drive device that moves the operating table; and providing a controller that controls the traction drive device, the controller including at least one control element;

wherein the traction drive device moves the operating table from a stopped state to a first speed based on a first actuation of the at least one control element;

wherein the first actuation of the at least one control element is interrupted for a first time period that is shorter than a first interruption time period;

wherein a second actuation of the at least one control element occurs after the first time period, the second actuation being within the first interruption time period; and wherein the second actuation of the at least one control element is interrupted for a second time period that is shorter than a second interruption time period.

14. The method of claim 13, further including a third actuation of the at least one control element following the second time period and occurring within the second interruption time period.

15. The method of claim 14, wherein the traction drive device moves the operating table at a second speed as long as the third actuation is not interrupted.

16. The method of claim 15, wherein the second speed is greater than the first speed.

17. The method of claim 15, wherein a third speed is activated by a double actuation of the at least one control element when the second drive speed is activated.

18. The method of claim 17, wherein a plurality of double actuations of the first control element are performed, each double actuation activating an operating table speed that is higher than the previous operating table speed, until a maximum operating table speed is reached.

19. A device for controlling a mobile operating table, comprising:

a controller that controls a traction drive device that moves the mobile operating table; and at least one control element disposed on the controller;

wherein the traction drive device moves the mobile operating table from a stopped state to a first speed based on a first actuation of the at least one control element;

wherein the first actuation of the at least one control element is interrupted for a first time period that is shorter than a first interruption time period;

wherein a second actuation of the at least one control element occurs after the first time period, the second actuation being within the first interruption time period;

wherein the second actuation of the at least one control element is interrupted for a second time period that is shorter than a second interruption time period;

wherein a third actuation of the at least one control element occurs after the second time period, the third actuation being within the second interruption time period; and wherein the traction drive device moves the operating table at a second speed that is greater than the first speed as long as the third actuation is not interrupted.

20. The device according to claim 19, further comprising a second control element, wherein:

the traction drive device is only operable when the second control element is actuated; and the traction drive device is deactivated when the second control element is not actuated.

* * * * *